US005573309A

United States Patent [19]

Bekessy

[11] Patent Number: 5,573,309

[45] Date of Patent: Nov. 12, 1996

[54] IN-LINE ROLLER SKATE WHEEL ASSEMBLY

[75] Inventor: George J. Bekessy, Post Falls, Id.

[73] Assignee: All American Aviation & Mfg. Inc., Post Falls, Id.

[21] Appl. No.: 327,291

[22] Filed: Oct. 21, 1994

[51] Int. Cl.[6] ..... B60B 5/02

[52] U.S. Cl. ..... 301/5.3; 301/64.7; 280/11.23

[58] Field of Search ..... 301/5.3, 5.7, 64.7; 280/11.22, 11.23, 11.19

[56] References Cited

U.S. PATENT DOCUMENTS

| | | | |
|---|---|---|---|
| 2,878,071 | 3/1959 | Fowlres | 301/5.3 |
| 3,389,922 | 6/1968 | Eastin . | |
| 3,501,162 | 3/1970 | Toone | 280/11.23 |
| 4,045,046 | 8/1977 | Taylor et al. | 280/87.04 A |
| 4,294,456 | 10/1981 | Tuell et al. | 280/11.28 |
| 4,603,868 | 8/1986 | Schutz | 280/7.13 |
| 4,648,610 | 3/1987 | Hegyi | 280/11.19 |
| 4,666,169 | 5/1987 | Hamill et al. | 280/11.23 |
| 4,844,492 | 7/1989 | Ludwig | 280/11.23 |
| 5,028,058 | 7/1991 | Olson | 280/11.22 |
| 5,046,746 | 9/1991 | Gierveld | 280/11.22 |
| 5,129,709 | 7/1992 | Klamer | 301/5.3 |
| 5,246,238 | 9/1993 | Brown | 280/11.2 |
| 5,253,884 | 10/1993 | Landers | 280/11.27 |
| 5,320,417 | 6/1994 | Trosky | 301/5.3 |
| 5,320,418 | 6/1994 | Chen | 201/5.3 |
| 5,401,037 | 3/1995 | O'Donnell et al. | 280/11.2 |

*Primary Examiner*—Russell D. Stormer

*Attorney, Agent, or Firm*—Wells, St. John, Roberts, Gregory & Matkin P.S.

[57] ABSTRACT

An in-line roller skate wheel and truck are described in which an elongated truck frame with a pair of spaced longitudinal side rails mount a plurality of roller wheels. At least one of the roller wheels has a hub core with a coaxial tire receiving shoulder. A tapered tire deflection controlling rim extends circumferentially about the shoulder, with rim side walls extending radially outward from a wide base at the tire receiving shoulder to a narrow peripheral surface. An annular resilient tire is mounted to the hub, engaging the tire receiving shoulder and encasing the tapered tire deflection controlling rim. The tire includes an annular ground engaging surface section and an annular high friction shoulder situated radially inward and axially outward of the ground engaging outer surface. The rim and tire configuration aid in maximizing speed and control in turns. Another one of the in-line roller wheels, situated at the heel end of the truck includes a tire of a slightly reduced diameter and is formed of a resilient material with a hardness value greater than the remaining tires on the truck. It also includes recessed braking dimples on its ground engaging surface to aid in approximating heels-forward "skid" stopping in a manner similar to stopping methods used by ice skaters.

18 Claims, 7 Drawing Sheets

Fig 2
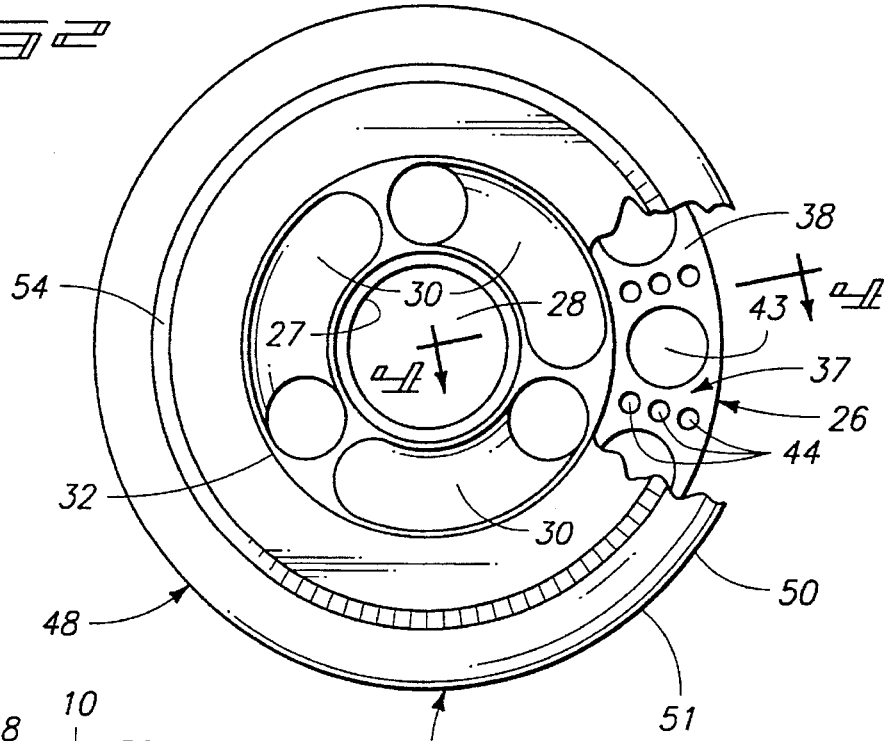
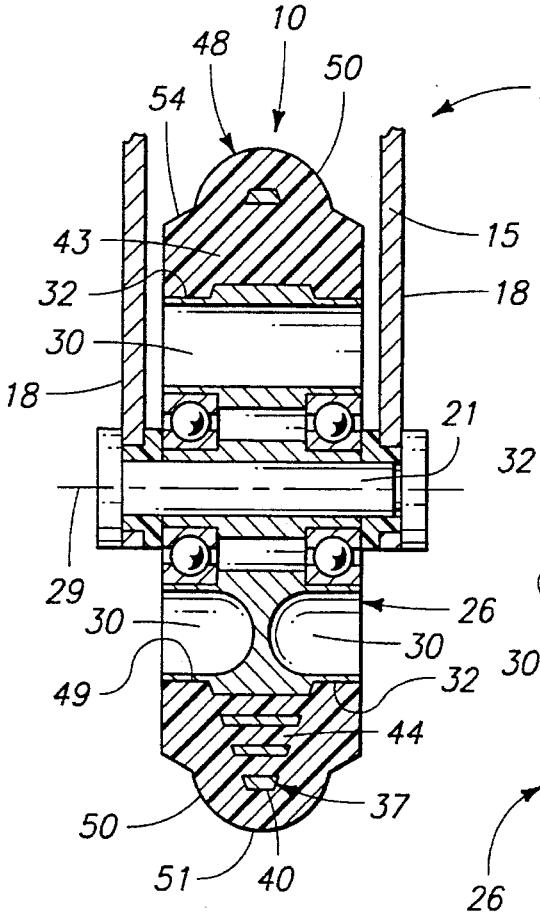
Fig 3
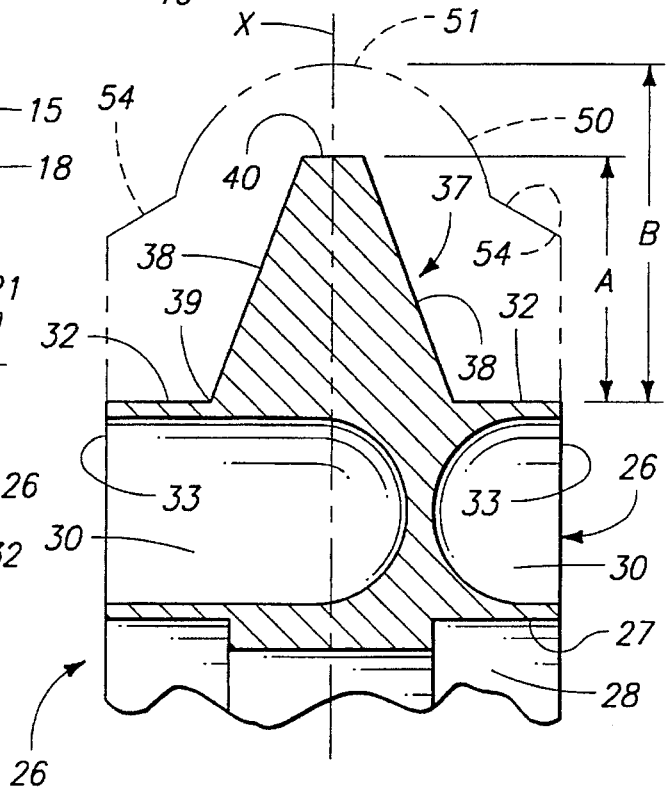
Fig 4

IN-LINE ROLLER SKATE WHEEL ASSEMBLY

TECHNICAL FIELD

The present invention relates to in-line roller skates and particularly to roller wheels for such skates.

BACKGROUND OF THE INVENTION

In-line roller skates continue to gain popularity, especially following the development of high friction, long wearing resilient materials such as urethane for the skate tires. In-line roller skates have substantial functional similarity to ice skates but are useful in nearly all climates. Further, the new tire materials enable relatively safe use of in-line roller skates on a variety of support surfaces. It is not uncommon to see such skates in use on concrete, asphalt, wood, composition floors, and even hard packed earth. Ice skates, on the other hand, are limited to use on ice or simulated ice surfaces.

Along with the development and popularity of in-line roller skates come challenges, among which are the need to maximize traction of the skates during turning, and to minimize friction during substantial straight line movement. This area has been a problem, especially since the skate tires are typically formed of solid material with a constant deflection characteristic regardless of the attitude of the wheel on straight line movement or in turns. Thus a skater desiring greater speed will choose a wheel that will produce minimum ground contact and thus minimal drag. Maneuverability is sacrificed with this type of wheel configuration. Likewise a skater desiring maneuverability will choose a wheel that will maximize ground contact to thus allow greater traction in turns.

Competitions often require both straight line speed and maneuverability in turns. The competitive skater must thus choose a design that has neither optimum speed or maneuverability characteristics, but an average of both. A need is thus realized by in-line skaters for skate tires and wheels that will have improved straight line speed and cornering abilities.

With all the similarities between ice skating and in-line roller skating, one aspect remains substantially different. To slow or stop on ice skates, the skater may simply skid sideways. To date, this method of stopping has not been easily accomplished by in-line roller skaters, at least by the inexperienced.

In-line skate wheel tires do not skid sideways on a hard support surface in the same way blades will skid over ice. In view of this, in-line roller skates typically have stationary brake pads at the heels or toes of the skate frames. In-line skaters stop by using the braking methods familiar to four wheel roller skaters; by engaging and dragging the brake pads along the support surface. This is awkward, difficult and often dangerous to learn, especially for novice in-line skaters. A need has therefore continued for in-line skates with improved "skid" type braking capabilities.

In consideration of the above problems, the present invention has for a first objective to provide an in-line skate wheel assembly that will maximize both speed and handling in turns.

Another objective is to provide such a skate wheel assembly that will enable "skid" type stopping in a manner similar to such stopping maneuvers available in ice skating.

These and further objects and advantages will become apparent from the following specification which, taken with the drawings describe the presently preferred mode for carrying out the present invention.

BRIEF DESCRIPTION OF THE DRAWINGS

Preferred embodiments of the invention are described below with reference to the accompanying drawings, which are briefly described below.

FIG. 2 is an enlarged fragmented side elevation of the preferred in-line roller wheel;

FIG. 3 is an enlarged sectional view taken along line 3—3 in FIG. 1;

FIG. 4 is an enlarged fragmented sectional view taken substantially along line 4—4 in FIG. 2;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
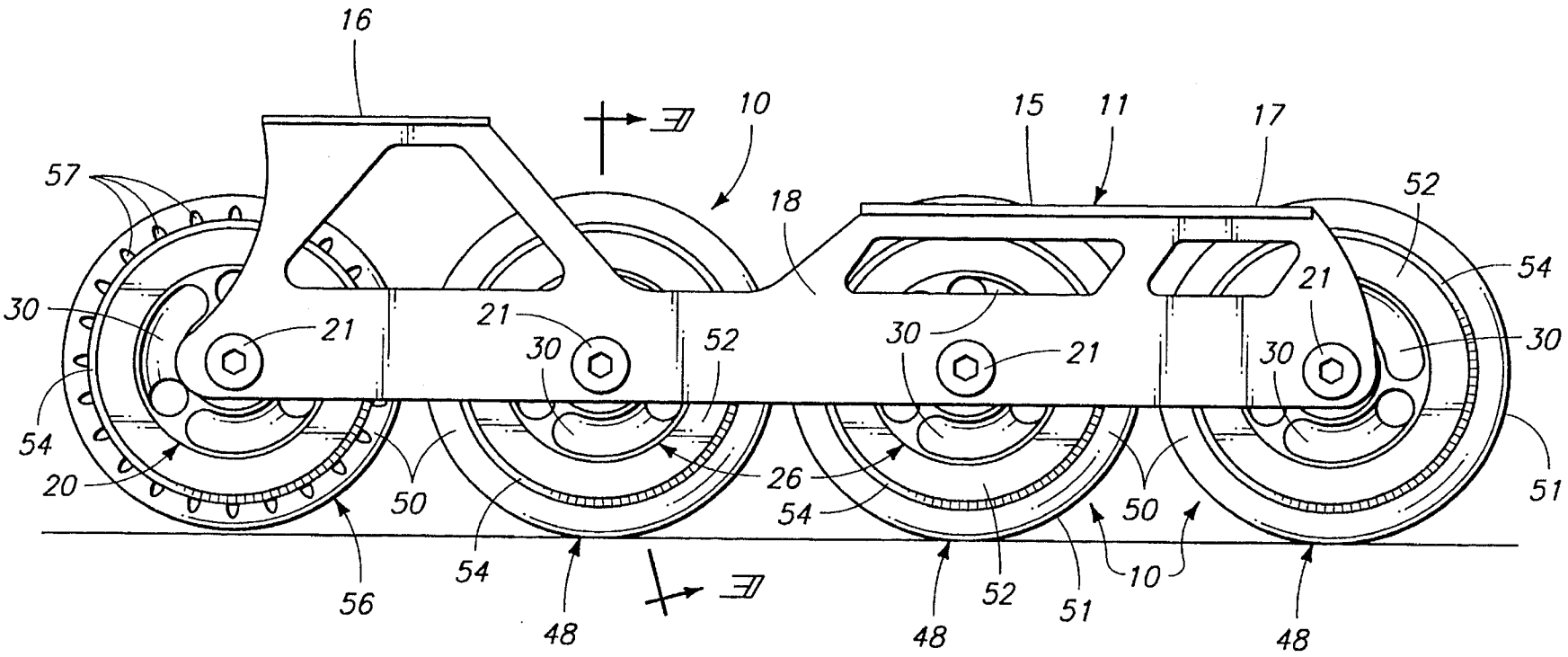
FIG. 1 is a side elevation view of an in-line roller skate truck and roller wheel of a preferred form.
Figure 5:
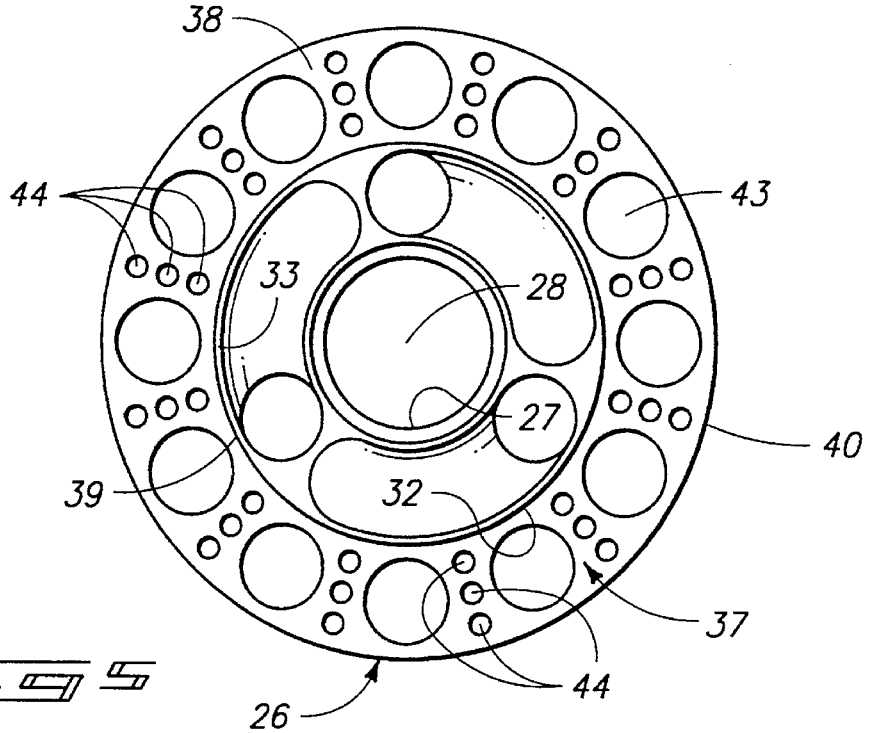
FIG. 5 is a side elevation of a preferred hub for the present in-line roller skate wheel.
Figure 6:
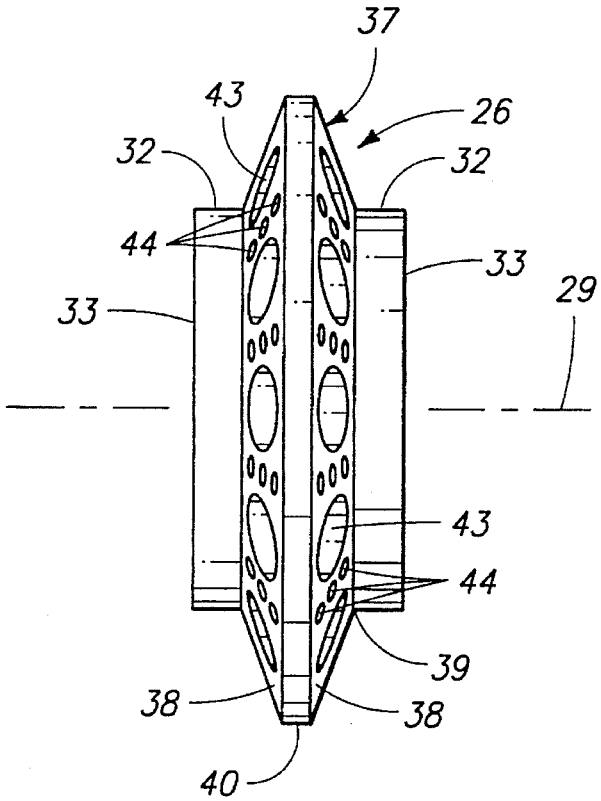
FIG. 6 is an edge view of the hub.

FIG. 1 generally shows a first preferred form of the present in-line roller skate wheel 10 mounted to a truck 11 as an assembly. In fact, several wheels 10 are mounted "in-line" along the truck, in the manner common to in-line roller skates in general. It is pointed out that the present invention may be produced as an assembly including the truck 11 and wheels 10, or the wheels 10 may be produced and provided separately.

The truck 11 includes a truck frame 15 that is elongated and formed of a rigid material such as aluminum. It extends from a heel portion 16 to a toe portion 17. The truck frame also includes a pair of spaced longitudinal side rails 18 below the heel and toe portions 16 and 17.

Wheel axles 21 are mounted between the side rails 18 at longitudinally spaced locations. In a preferred form, each of the axles 21 mounts one of the present wheels 10. Bearings 22 (FIG. 3), of conventional form typically used for in-line roller skate wheels, are advantageously used to mount the present wheels 10 to the axles 21 for free rotation thereon.

Details of a wheel 10 exemplifying one of the several shown in FIG. 1 are shown in FIGS. 2–6. The wheel 10 generally includes a hub 26 that is formed of a rigid material such as injection molded fibrous carbon, graphite compounds, aluminum, or other light weight, strong materials.

The hub 26 includes a hub core 27 that is provided with a central axle bore 28. The bore 28 may be shaped to receive and mount the opposed bearings 22 (FIG. 3), which, in turn, are mounted on an axle 21. The hub will rotate freely on the bearings about a wheel axis 29.

Spiral slots 30 may be formed in the hub radially outward of the bore 28. The slots 30 are functional in the sense that they reduce the overall weight of the wheel. The slots 30, being formed in spiral configuration, also have a visually pleasing appearance.

The hub 26 also includes a substantially cylindrical tire receiving shoulder 32 that extends axially between shoulder edges 33. The tire receiving shoulder 32 is coaxial with the bore 28 and wheel axis 29. The shoulder 32 is substantially axially centered on a central reference plane X that is substantially perpendicular to the wheel axis 29 (FIG. 4).

A tapered tire deflection controlling rim 37 extends circumferentially about the tire receiving shoulder 32. It includes rim side walls 38 that extend radially outward from a wide base 39 at the tire receiving shoulder 32. The side walls 38 converge from the wide base 39 to a narrow peripheral surface 40.

In a preferred form, the tapered tire deflection controlling rim 37 includes a plurality of holes 43 formed into the side walls 38. In the example shown, the holes 43 extend through the rim 37 and are formed on axes that are spaced substantially equiangularly about the wheel axis 29. In a preferred form, the hole axes are parallel to the wheel axis 29.

Smaller holes 44 are also shown in the illustrated example. The holes 44 are arranged in radial alignment in groups that are interspersed between successive larger holes 43. Both sets of holes 43, 44 receive portions of an annular resilient tire 48 that engages the shoulder 32 and encases the rim 37.

The tire 48 is formed of a solid resilient material such as urethane, molded about the hub 26 The molded material will fill the holes 43, 44, thereby securing the tire to the hub.

The tire 48 includes an inside surface 49 that abuts the tire receiving shoulder 32 and encases the tapered tire deflection controlling rim 37. Tire 48 also includes an annular ground engaging outer surface 50. A preferred form for the surface 50 includes an outward ground engaging surface 51 that is axially arcuate (FIG. 3) and leads to substantially vertical side wall sections 52. In the illustrated example, the side wall sections are substantially axially aligned with the axial edges 33 of the tire receiving shoulder 32.

Figure 9:
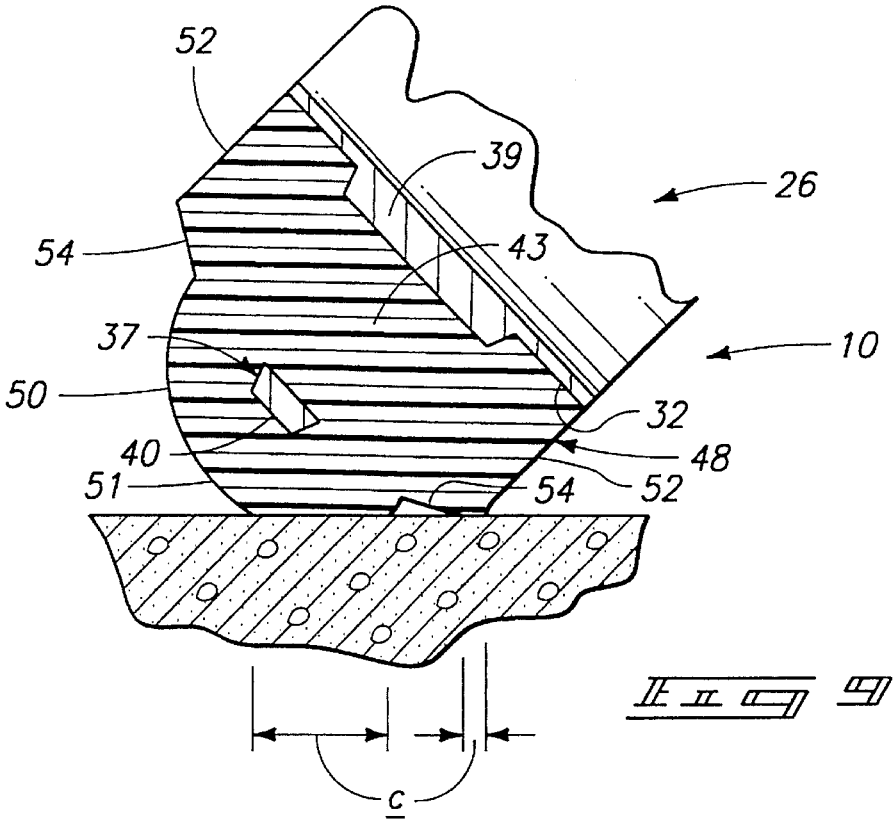
Figure 10:
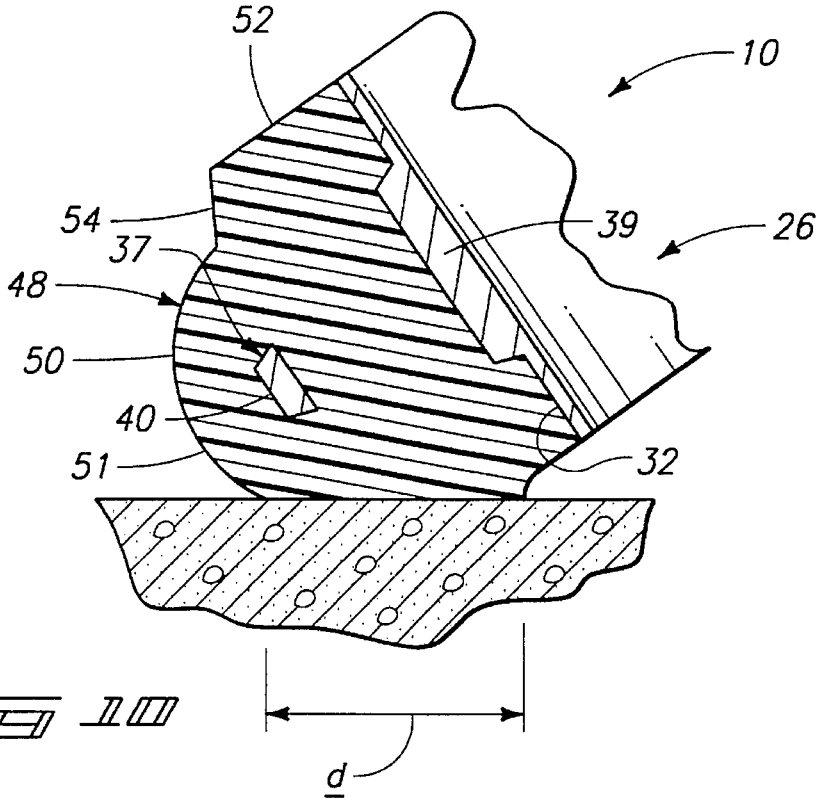
Figure 11:
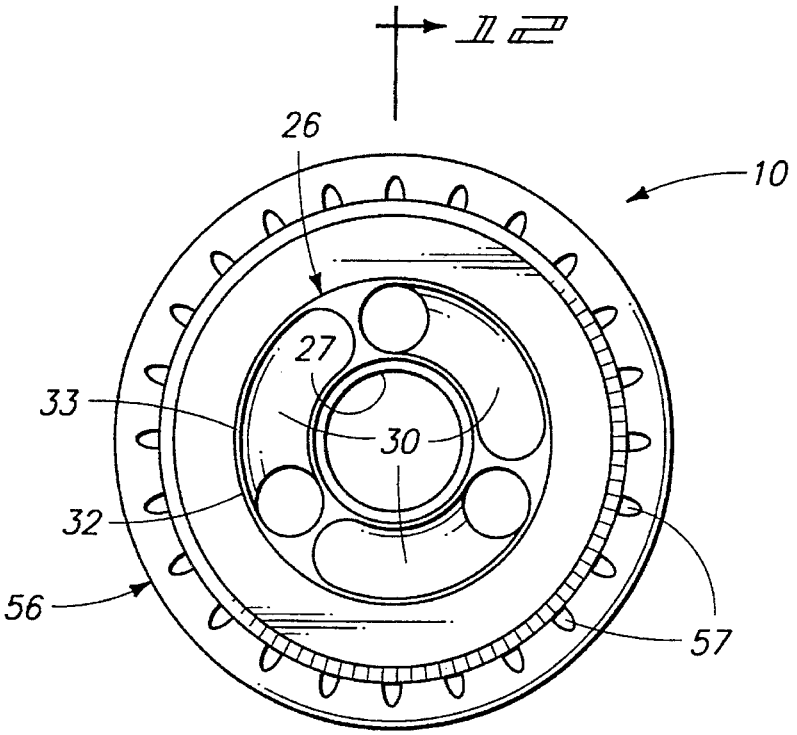
FIG. 11 is a side elevation of another preferred wheel.
Figure 12:
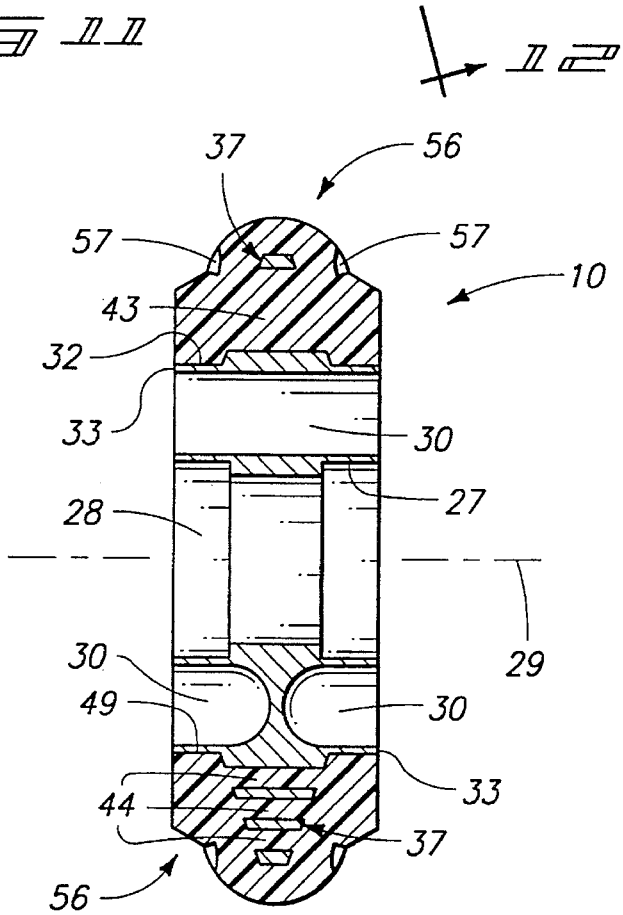
FIG. 12 is an enlarged sectional view of the wheel, taken along line 12—12 in FIG. 11.
Figure 13:
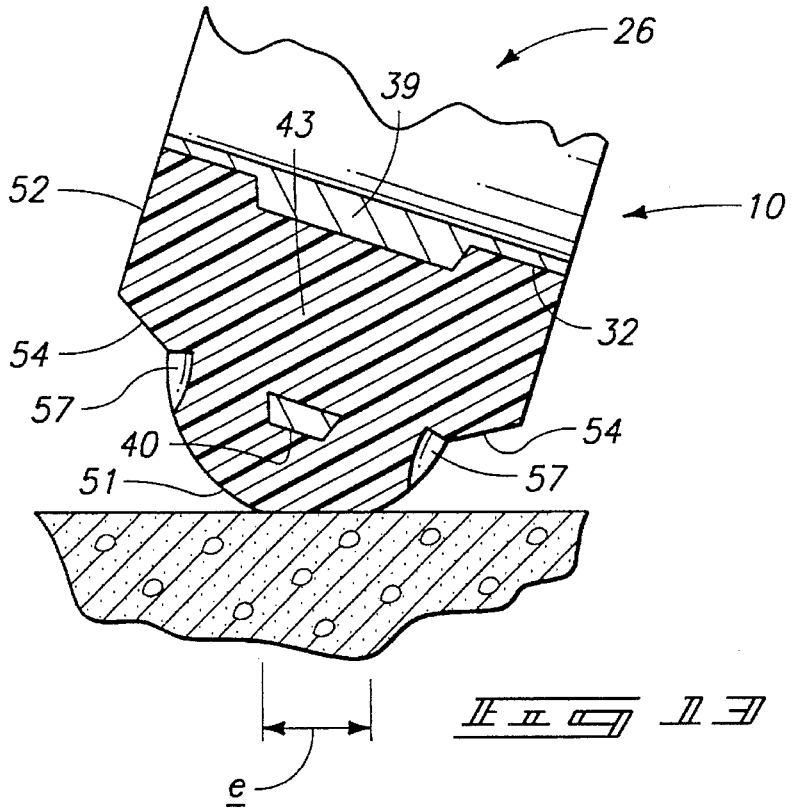
FIGS. 13 and 14 are operational views showing another form of wheel tire during use.

An annular high friction shoulder 54 is advantageously provided on the tire radially inward of and axially outward of the ground engaging outer surface 51. Shoulder 54 is formed as an angular surface that leads angularly and axially outward from the outer surface 51 to the side wall sections 52. Shoulder 54 is used, along with the tire deflection controlling rim 37, to maximize surface contact with the ground or other support surface during sharp turns (FIGS. 9, 10).

Another tire 56 (FIGS. 1, and 11–14) is provided that is similar to the tire 48 but with differences that facilitate "skid" braking. The tire 56 is mounted to a hub that is substantially identical to the hub 26 described above. It is also pointed out that the tire 56 incudes a ground engaging outer surface, tread section, high friction surface, and side walls, etc. that are substantially similar to those described above for tire 48. For this reason like numerals will identify these similar surfaces on the tire 56.

The tire 56 in one preferred form is of a slightly smaller overall diameter than the tire 48 (advantageously 2 mm smaller in diameter). When placed in the rearward most position on the truck frame 15 (FIG. 1), the tire 56 will ride just slightly higher over a flat floor surface and will fully contact the floor when the skater leans slightly rearwardly. This action lifts the forward two tires, leaving only the back two tires in full engagement against the floor. Surface contact with the floor is thereby reduced, consequently reducing resistance to sideways "skidding" during braking or "skid" stopping.

Another difference between the tire 56 and tire 48 is found in the hardness of the materials selected. The typical tire 48 includes a hardness value in the range of approximately 78 to 80 shore A durometer. The tire 56 has a hardness value greater than the tire 48, for example in the range of approximately 89 to 93 shore A durometer. This increased hardness causes the tire 56 to have less grip on the floor surface and therefor more of a tendency to "skid" during the sideways ice skater type stop. Thus the tire 56 will deflect less when engaging the floor surface than the tires 48, resulting in less contact surface (dimension e in FIG. 13) than the tires 48 when tilted at the same angle.

A further difference between the tire 56 and tire 48 is the provision of recessed braking dimples 57 situated about its ground engaging surface 50 and radially inward of the tread section 51. Most preferably, the dimples are spaced substantially equiangularly about the axis 29 and are radially outward of and adjacent to the high friction shoulder 54.

Figure 14:
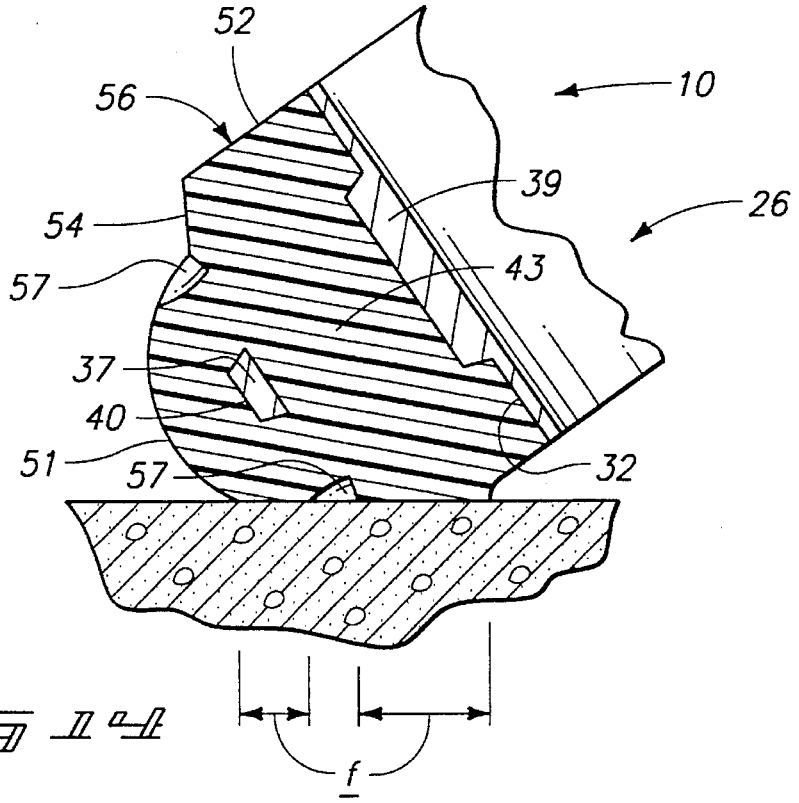

The braking dimples 57 are so positioned so as not to interfere with the ground engaging surface 50 during normal operation of the associated wheel, as in straight line skating or in gentle turns. Instead, they come into play when the skater is braking in a "skid" stop. Here, the skates are tipped to a maximum angle as the skater leans sideways, places weight on the heels, and "skids" to a stop. When the tire is tipped as shown in FIG. 14, the dimples 57 form channels or areas that do not engage the floor and that consequently reduce the frictional resistance to the sideways "skid".

FIG. 4 illustrates some dimensional relationships between either tire 48 or 56 and the associated hub 26 that affect traction during use. The narrow peripheral surface 40 of the tapered tire deflection controlling rim 37 is spaced radially from the tire receiving shoulder 32 by a distance A. The tire 48 or 56 includes a radial thickness dimension B from the tire receiving shoulder 32. The distance A is greater than one half the thickness dimension B.

The above tire-rim relationship, coupled with the tapered geometry of the deflection controlling rim 37, and provision of the holes 43 have been found to significantly affect the performance of the wheels and in operation.

Figure 7:
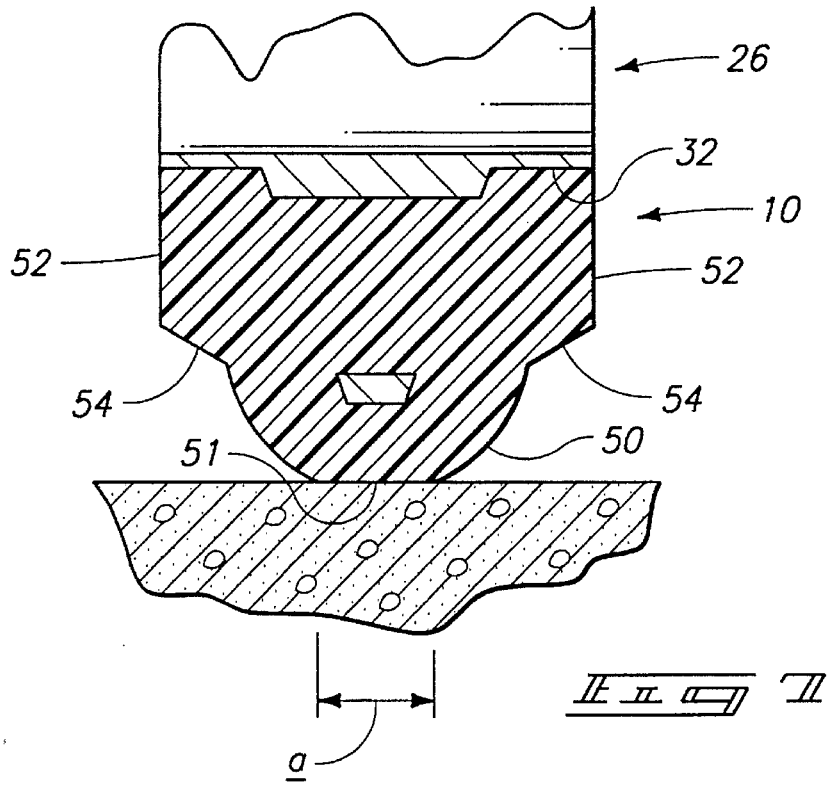
FIGS. 7–10 are operational views showing different angular attitudes of a wheel during use.

In operation, during straight line skating, the wheels roll along the floor substantially vertically, with the wheel axes substantially parallel to the floor or other support surface. During this time the operational thickness of the tires is effectively the radial distance between narrow peripheral hub surface 40 and the floor. This relationship is shown graphically in FIG. 7. Here deflection is minimal and only narrow surfaces of the tires contact the floor, as demonstrated by the distance a in FIG. 7. Frictional resistance is low, allowing maximum speed.

Figure 8:
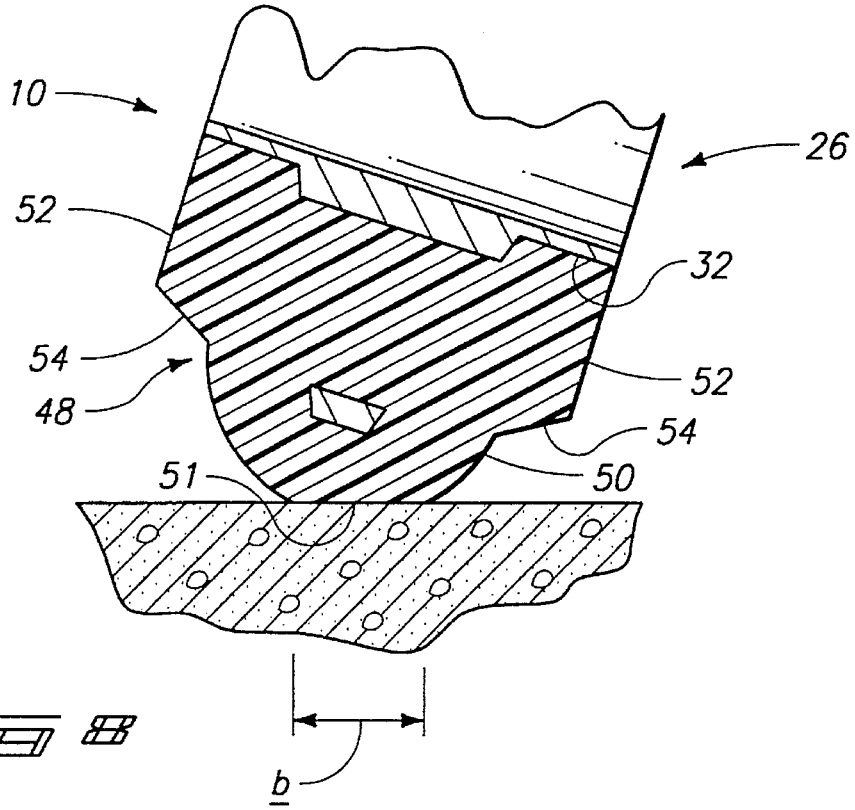

As the skater leans into a gradual turn, the wheels tip laterally and angularly as shown in FIG. 8. Here there is slightly more load applied to the tires due to the skater's weight and centrifugal force. As the wheels tip, the effective vertical thickness of the tire gradually increases (due to the tapered nature of the rim), exposing more of the resilient tire material to engage the floor surface as shown by the distance b in FIG. 8. The result is that the tires deflect proportionally more against the floor surface, increasing surface contact and frictional resistance to side slip. The skater is thus able to maintain needed control without significantly loosing speed.

As the skater goes into a hard turn, the wheels tip further, to the approximate angles shown in FIGS. 9 and 10. As this happens the effective vertical thickness increases again due to the tapered nature of the rim. Such effective thickness is increased even more through the holes 43. Thus the tire material is allowed to deflect even more to allow more surface contact (see distances c and d in respective FIGS. 9 and 10). In addition, the high friction shoulders 54 now come into contact with the floor surface, further increasing the contact surface area and maximizing the resistance to the significantly increased lateral loading caused by the skater's weight and centrifugal force.

If the skater desires to turn gradually or sharply, weight distribution is maintained by the skater so that all the tires remain in full contact with the floor surface. Resistance to sideward "skidding" is therefor maximized and the turn may be executed without significantly reducing forward momentum (or rearward momentum if the skater is skating backwards).

If the skater desires to stop, a sharp turn is made with the skater's weight shifted to the heel sections 16 of the trucks 11. Now the trucks toe sections tip upwardly and the rear wheel tires 56 come into operational contact with the floor surface (see the contact surface span e in FIG. 13). As the two forward tires are lifted, their surface contact area is reduced along with resistance to lateral sliding. This tendency is encouraged by the rear tires 56 which, being harder and including the braking dimples 57, will "skid" sideways more easily than the next forwardly adjacent tires 48. The in-line roller skater will thus "skid" safely to a stop with heels foremost, in a manner akin to an ice skater "skidding" sideways to a stop.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An in-line roller skate wheel, comprising:

a wheel hub having:

(a) a hub core including a central axle bore formed along a wheel axis;

(b) substantially cylindrical tire receiving shoulders concentric with the bore;

(c) a tapered tire deflection controlling rim extending circumferentially about the shoulders and having rim side walls extending radially outward and tapering from a wide base at the shoulders to a narrow continuous and unbroken peripheral surface; and an annular resilient tire mounted to the wheel hub, engaging the tire receiving shoulders and encasing the tapered tire deflection controlling rim.

2. An in-line roller skate wheel as claimed by claim 1 wherein the tapered tire deflection controlling rim includes a plurality of holes formed in the tapered tire deflection controlling rim on hole axes spaced substantially equiangularly about the wheel axis; said tire being formed to extend into the plurality of holes.

3. An in-line roller skate wheel as claimed by claim 1 wherein the tapered tire deflection controlling rim includes a plurality of holes formed in the tapered tire deflection controlling rim on hole axes spaced substantially equiangularly about the central axle bore, said hole axes being substantially parallel to the wheel axis.

4. An in-line roller skate wheel as claimed by claim 1 wherein:

the narrow peripheral surface of the tapered tire deflection controlling rim is spaced radially from the tire receiving shoulders by a distance A;

wherein the tire includes a radial thickness dimension B from the tire receiving shoulders; and wherein the distance A is greater than one half the thickness dimension B.

5. An in-line roller skate wheel as claimed by claim 1 wherein the tire, rim side walls, narrow peripheral surface and tire receiving shoulders are substantially axially centered on a central reference plane X that is substantially perpendicular to the wheel axis.

6. An in-line roller skate wheel as claimed by claim 1 wherein the tire includes:

an annular ground engaging surface section; and annular high friction shoulders situated radially inward and axially outward of the ground engaging outer surface.

7. An in-line roller skate wheel as claimed by claim 1 wherein the tire includes:

an annular ground engaging surface section including an annular tread section and side wall sections, the annular tread section being situated radially outward of the side wall sections; and recessed braking dimples formed in the ground engaging surface section radially inward of the annular tread section and spaced substantially equiangularly about the wheel axis.

8. An in-line roller skate wheel as claimed by claim 1 wherein the tire includes:

an annular ground engaging surface section including an annular tread section and side wall sections, the annular tread section being situated radially outward of the side wall sections; and recessed braking dimples formed in the annular ground engaging surface section radially inward of the annular tread section and spaced substantially equiangularly about the wheel axis; and annular high friction shoulders situated radially inward and axially outward of the ground engaging outer surface section.

9. An in-line roller skate wheel hub, comprising:

a hub core including a central axle bore;

substantially cylindrical tire receiving shoulders concentric with the bore; and a tapered tire deflection controlling rim extending circumferentially about the shoulders and having rim side walls converging radially outward from a wide base at the shoulders to a narrow continuous and unbroken peripheral surface.

10. An in-line roller skate wheel hub as claimed by claim 9 wherein the tapered tire deflection controlling rim includes a plurality of holes formed in the tapered tire deflection controlling rim on hole axes spaced substantially equiangularly about the wheel axis.

11. An in-line roller skate wheel hub as claimed by claim 9 wherein the tapered tire deflection controlling rim includes a plurality of holes formed in the tapered tire deflection controlling rim on hole axes spaced substantially equiangularly about and parallel to the wheel axis.

12. An in-line roller skate wheel, comprising:

a hub formed about a central rotational axis;

a tire body of a resilient material formed over the hub for rotation with the hub about the central rotational axis;

said tire body including an annular ground engaging outer surface, and an annular high friction side shoulders spaced radially inward of and projecting axially from the ground engaging outer surface;

said high friction side shoulders intersecting in a non-tangential manner with the annular ground engaging outer surface and being substantially frusto-conical and angularly inclined with respect to the rotational axis;

whereby the annular ground engaging outer surface will roll against a support surface with the central rotational axis substantially parallel to the support surface, and the annular ground engaging outer surface and one of the annular high friction side shoulders will roll against the support surface with the central rotational axis tilted with respect to the support surface.

13. An in-line roller skate wheel as claimed by claim 12, wherein the annular ground engaging outer surface includes recessed braking dimples spaced substantially equiangularly about the rotational axis.

14. An in-line roller skate wheel as claimed by claim 12, wherein the resilient material of the tire includes a hardness shore durometer value of approximately 80 A.

15. An in-line roller skate truck roller wheel assembly, comprising:

an elongated truck frame extending from a heel portion to a toe portion and having a pair of spaced longitudinal side rails;

wheel axles extending between the side rails at longitudinally spaced locations; in-line ground engaging roller wheels mounted on respective wheel axles;

wherein at least one of the in-line roller wheels has:

(a) a hub core having a central axle bore receiving an axle;

(b) substantially cylindrical tire receiving shoulders concentric with the axle bore;

(c) a tapered tire deflection controlling rim extending circumferentially about the shoulders and having rim side walls extending radially outward from a wide base at the tire receiving shoulders to a narrow continuous and unbroken peripheral surface; and (d) an annular resilient tire mounted to the hub, engaging the tire receiving shoulders and encasing the tapered tire deflection controlling rim.

16. An in-line roller skate truck roller wheel assembly as claimed by claim 15, wherein the tire includes:

an annular ground engaging surface section; and annular high friction shoulders situated radially inward and axially outward of the ground engaging outer surface.

17. An in-line roller skate truck roller wheel assembly as claimed by claim 15, wherein the tire includes:

an annular ground engaging surface section;

annular high friction shoulders situated radially inward and axially outward of the ground engaging outer surface; and wherein the annular ground engaging outer surface includes recessed braking dimples spaced substantially equiangularly about the rotational axis.

18. An in-line roller skate truck roller wheel assembly as claimed by claim 15, wherein said at least one in-line roller wheel tire is formed of resilient material having a first hardness value and further comprising:

another one of the in-line roller wheels having a tire formed of a resilient material of a second hardness value greater than the first hardness value.

* * * * *